US008541675B2

(12) United States Patent
Strickland

(10) Patent No.: US 8,541,675 B2
(45) Date of Patent: Sep. 24, 2013

(54) SOUND MODIFICATION DEVICE FOR PERCUSSION INSTRUMENTS

(76) Inventor: Mathew Ephram Strickland, Burlingame, CA (US)

( * ) Notice: Subject to any disclaimer, the term of this patent is extended or adjusted under 35 U.S.C. 154(b) by 163 days.

(21) Appl. No.: 12/924,566

(22) Filed: Sep. 30, 2010

(65) Prior Publication Data

US 2011/0192268 A1 Aug. 11, 2011

Related U.S. Application Data

(60) Provisional application No. 61/277,825, filed on Sep. 30, 2009.

(51) Int. Cl.
*G10D 13/08* (2006.01)
*G10D 13/02* (2006.01)

(52) U.S. Cl.
USPC ..... 84/411 M

(58) Field of Classification Search
USPC ..... 84/411 M
See application file for complete search history.

(56) References Cited

U.S. PATENT DOCUMENTS

| | | | | |
|---|---|---|---|---|
| 4,567,807 | A * | 2/1986 | Robinson | 84/411 M |
| 6,291,754 | B1 * | 9/2001 | Gatzen et al. | 84/411 M |
| 6,696,630 | B2 * | 2/2004 | Gatzen | 84/411 M |
| 7,569,758 | B2 * | 8/2009 | Harada et al. | 84/411 M |
| 2008/0264233 | A1 * | 10/2008 | Gatzen | 84/411 M |

* cited by examiner

*Primary Examiner* — Jeffrey Donels

(57) ABSTRACT

The invention is a sound modification device used for a percussion instrument. It is comprised of a rigid body, interchangeable absorbent inserts, and a magnet. Once assembled and placed on the skin of a drum, these three pieces work together to make a highly effective and versatile damper to eliminate unwanted ranginess when drum is struck. The damper can be slid around the perimeter of the drum until the desired sound is achieved. The weight of the damper body adds mass to the drum, the magnet adds pull to the rim of the drum to hold the damper, and the absorbent inserts tailor the amount of dampening desired by the musician.

8 Claims, 7 Drawing Sheets

SOUND MODIFICATION DEVICE FOR PERCUSSION INSTRUMENTS

This application claims priority of provisional patent titled A sound modification device for percussion instruments; filed on the date of Sep. 30, 2009, having Ser. application No. 61/277,825, the entire contents of which are incorporated herein its entirety.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of music. More particularly, the present invention is in the technical field of music modification. More particularly, the present invention is in the technical field of a music modification device for any percussion instrument.

PRIOR ART

1. Dampening Material for a Drum
   United States Patent Application 20030233928
   Kind Code A1
   Gatzen, Robert A. Dec. 25, 2003
2. Dampening Material for a Drum
   United States Patent Application 20050200059
   Kind Code A1
   Smith, Lane: et al. Sep. 15, 2005
3. Sound Modification System
   United States Patent Application 20070056428
   Kind Code A1
   May; James H. JR. Mar. 15, 2007
4. Bass Drum Mute
   United States Patent Application 20080264233
   Kind Code A1
   Gatzen; Robert A. Oct. 30, 2008

SUMMARY OF THE INVENTION

The sound modification device for a percussion instrument will be referred to as the vibration "damper" for the purpose of this application. The vibration damper or damper is an invention for modifying the sound made by a vibratible surface, such as a drumhead used for creating music. The damper may be comprised of one or more rigid surfaces and one or more flexible surfaces to be in contact with a vibratable surface, plus at least one integrated magnet that could be removably adhered to some portion of a percussion instrument such as the rim of a drum.

BRIEF DESCRIPTION OF DRAWING

FIG. 6 also shows that the damper can be slid to desired spot on the drum;

DETAILED DESCRIPTION OF THE INVENTION

Figure 1:
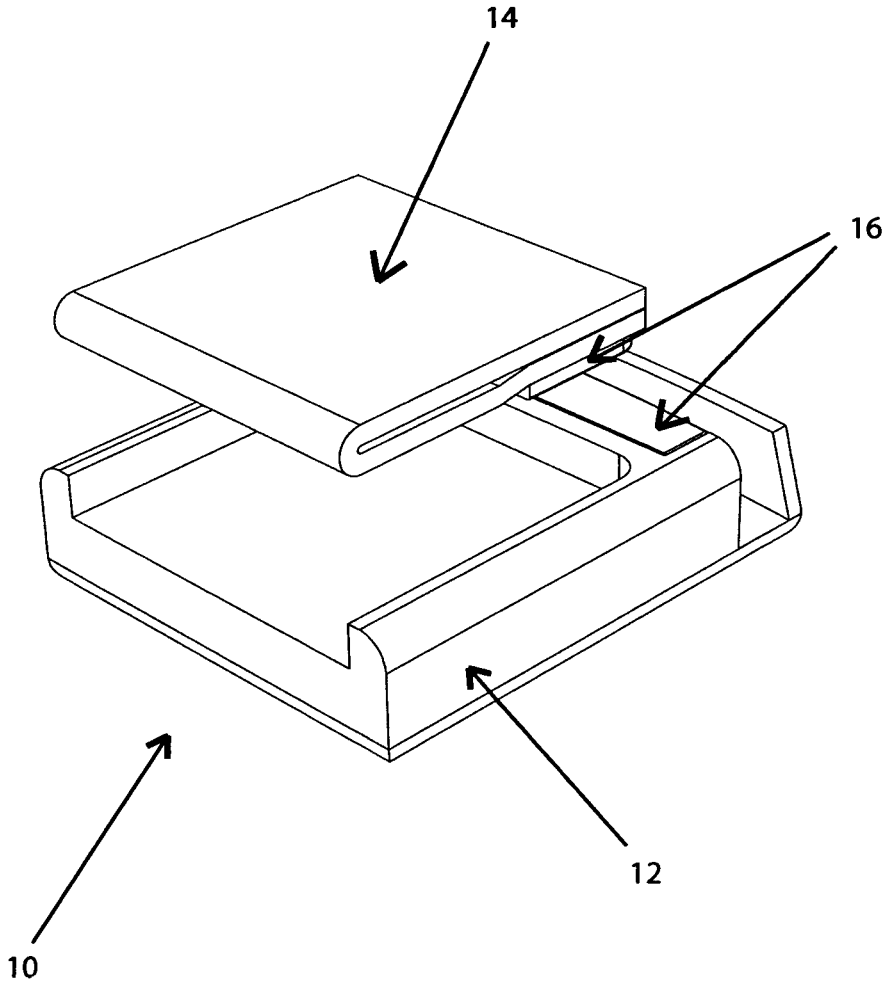
FIG. 1 is an upside down inside perspective, exploded view, of the damper with insert.

Referring now to the damper in more detail in FIG. 1; is an upside down perspective view of the damper according to one embodiment of the present invention and is not intended to limit the scope of the present invention. The damper 10 is shown having at least one rigid surface 12 attaching to at least one flexible surface 14. The present device will be described more with FIGS. 1 thru 9 and may be used in any appropriate application with sound producing equipment.

In further detail, still referring to the damper of FIG. 1; The rigid surface 12 may be wood, stone, hard plastic, alloy, or any sufficiently durable surface, but most preferably a metal surface. The rigid surface 12 could be wavey, flat, holed, angled, textured, or any combination of these, but most preferably a smooth and flat surface. The flexible surface 14 could be cotton, synthetic leather or any combination of soft fibrous materials, but most preferably leather. The flexible surface could be of any weight, size, color, or thickness.

The construction details of the damper as shown in FIG. 1;

The rigid surface 12 may be any shape: oval, round, square, triangular, etc, but preferably rectangular in shape. The size of the rigid surface 12 could be, but is not limited to, 1⅞ inches wide×2¼ inches long×⅝ inch thick with rounded corners. The flexible surface 14 could be constructed out of one or more pieces of leather or a combination of leather and metal or plastic or both. The leather could be attached to a ferrous material and be attracted to the integrated permanent magnet in the said damper. The flexible surface 14 could be attached to the rigid surface 12 by glue, screws, or hook and loop or another magnet. The flexible surface 14 could be at least one piece of leather and arranged in any way with the magnet 16.

Figure 2:
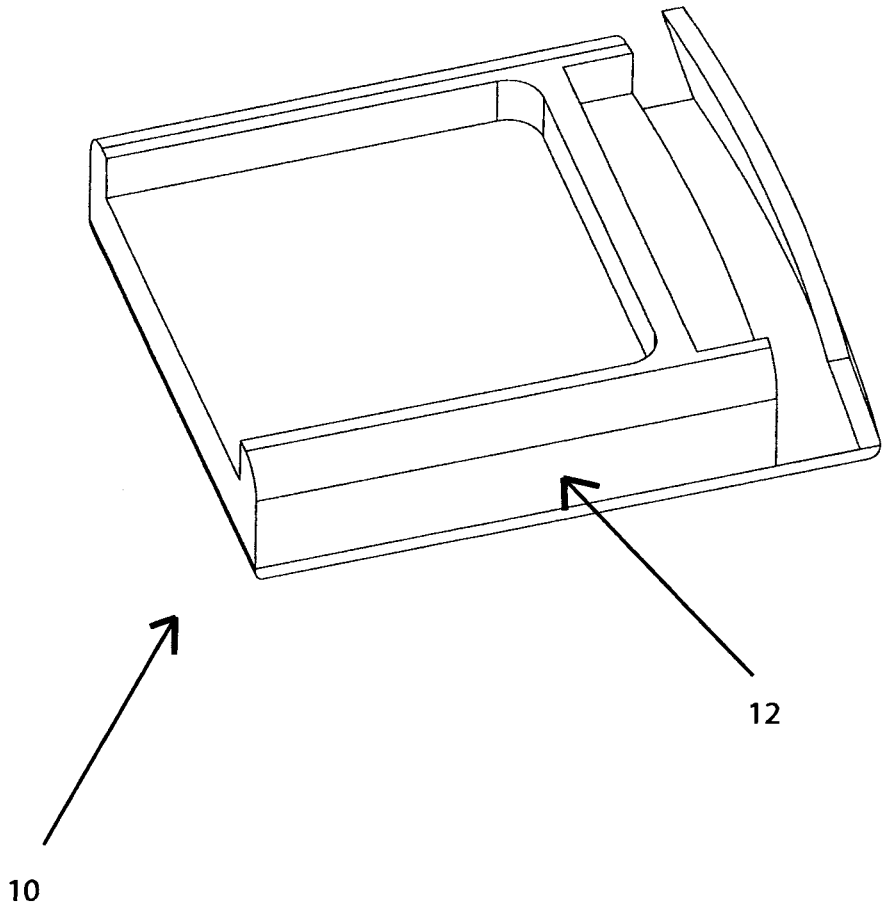
FIG. 2 is the inside view of just the rigid surface of the damper.

Referring now to the damper in FIG. 2; which shows the damper 10 with an inside view of the rigid surface 12.

In further detail, still referring to the damper of FIG. 2; The rigid surface 12 could be the base.

The construction details of the damper as shown in FIG. 2; The rigid surface 12 could be constructed in pieces but most preferable one solid piece.

Figure 3:
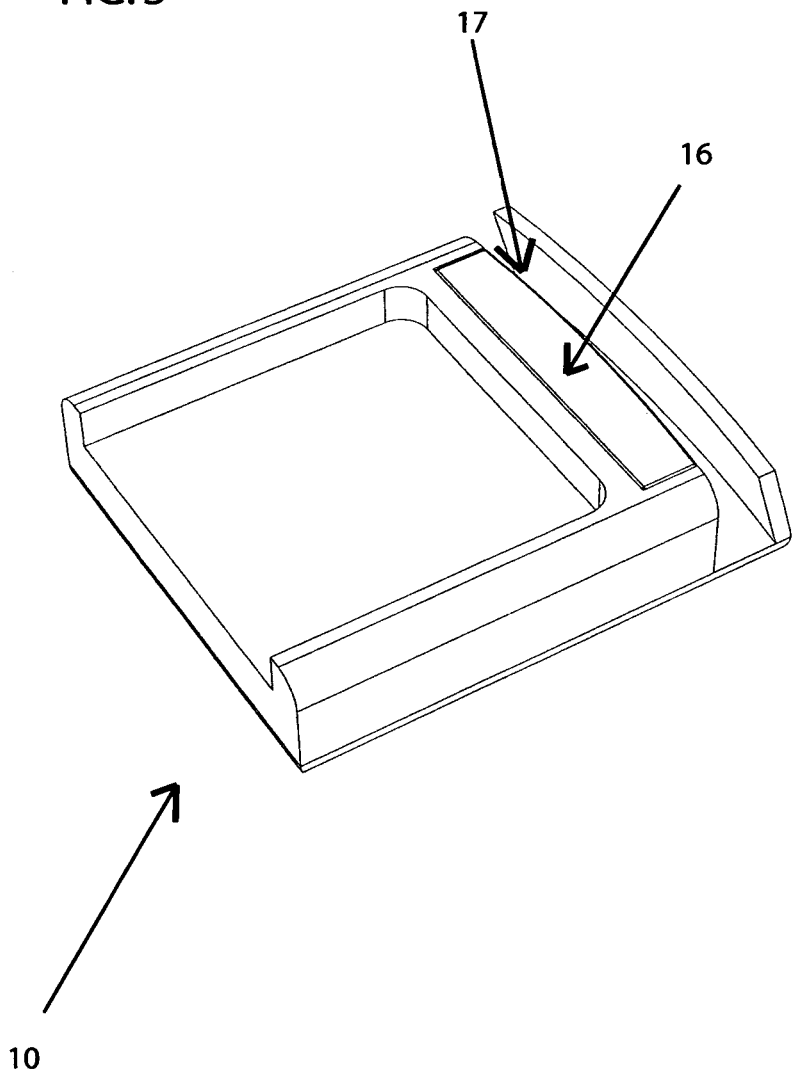
FIG. 3 is a perspective view of rigid surface and integrated magnet of the damper.

Referring now to FIG. 3; of the damper 10; the magnet 16 could occupy all or part of the surface area of the base 12 but it not limited to this form. The magnet 16 could be dipped and or coated with any other material: rubber, plastic etc. The magnet 16 could be 1½ inches long×¼' inch wide×¼ inch thick with a 7.1 radius 17, glued, screwed, or adhered in any way to the rigid surface 12.

Figure 4:
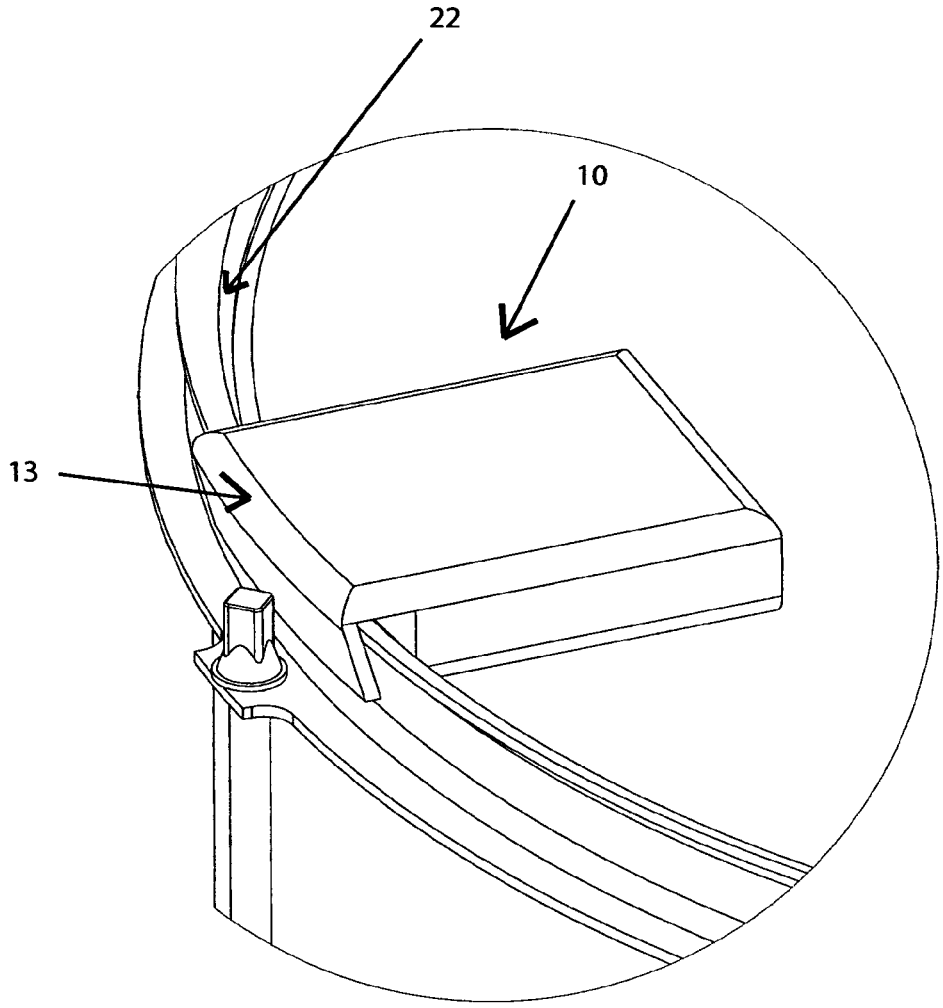
FIG. 4 is the perspective view of the assembled damper releasably adhered to the rim of drum.

Referring now to FIG. 4; Still referring to the damper 10, the length of the perimeter of the rigid surface 12, could be curved or straight but preferably curved at a radius 13 of 7.124 in a way to conform to the inside shape of a standard snare drum rim 22.

Figure 5:
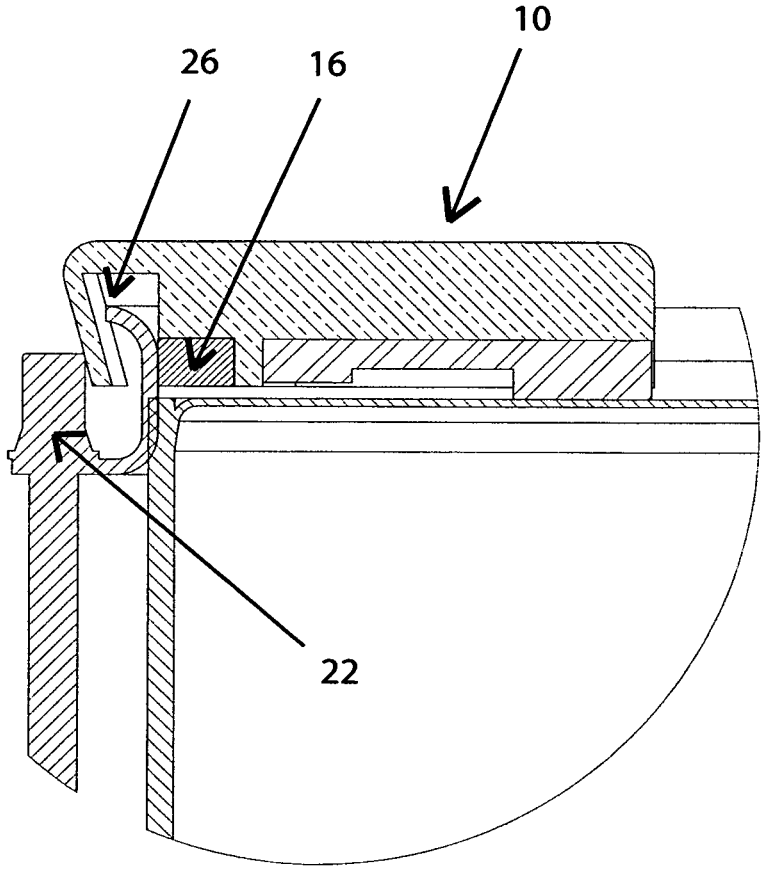
FIG. 5 is the cut side view of the damper sitting on top of the drumhead within the inside rim of a drum. Also shows a slot that could be used to attach the damper to a non-magnet-able drum rim.

Referring now to FIG. 5; Still referring to the damper 10 the vertical slot angle 26 could be preferably 105 or 15 degrees, or any angle around the perimeter of the present device 10 that fits snuggly inside any rim 22 of any drum. The magnet 16 could releasably attach itself to the inside of the rim 22. With the addition of a precise radius arc and vertical slot angle 26 the damper can maintain a secure fit even without the use of a magnet for non-ferrous snare drum rims.

Figure 6:
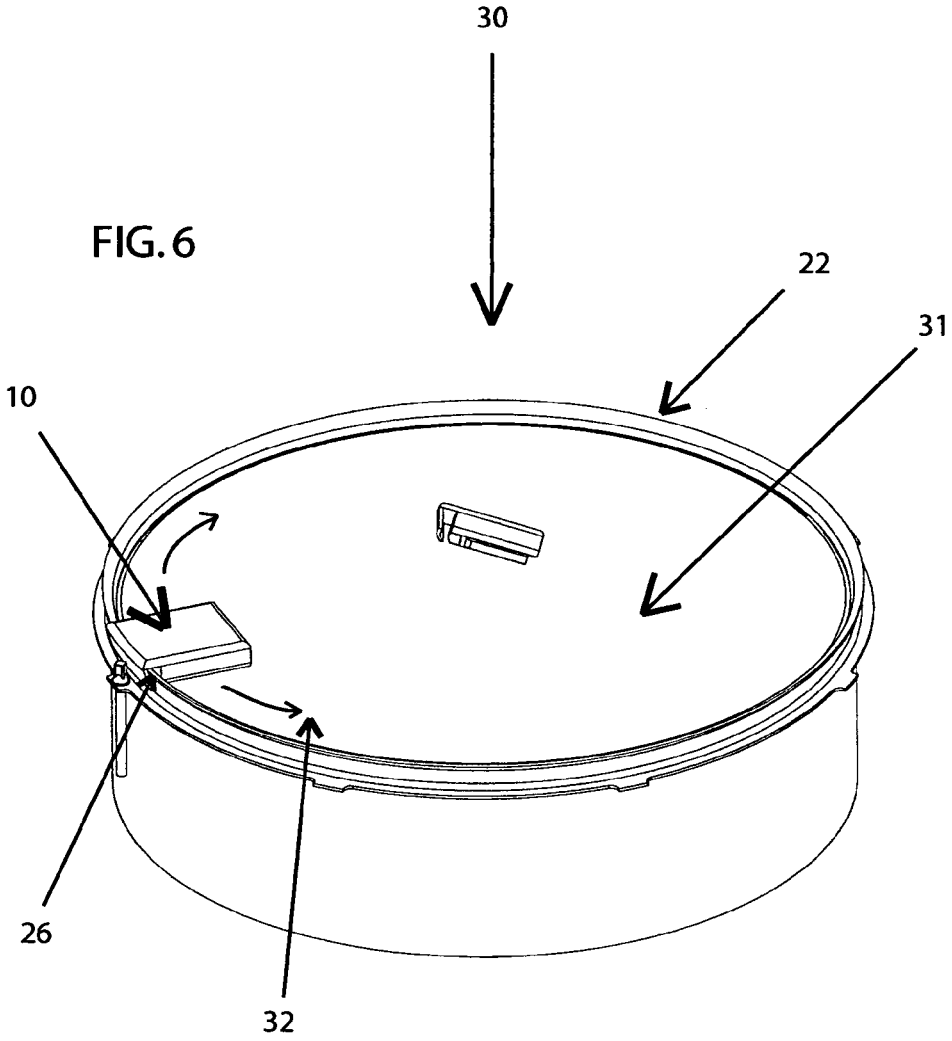
FIG. 6 is the distant perspective view of the damper within the scope of a full sized drum, rim and drumhead.

Referring now to FIG. 6; this is the distant perspective view of the damper 10 within the scope of a full sized drum 30, rim 22 and drumhead 31. FIG. 6 also shows that the damper can be slid 32 via the slot 26 to desired spot on the drum 30.

Figure 7:
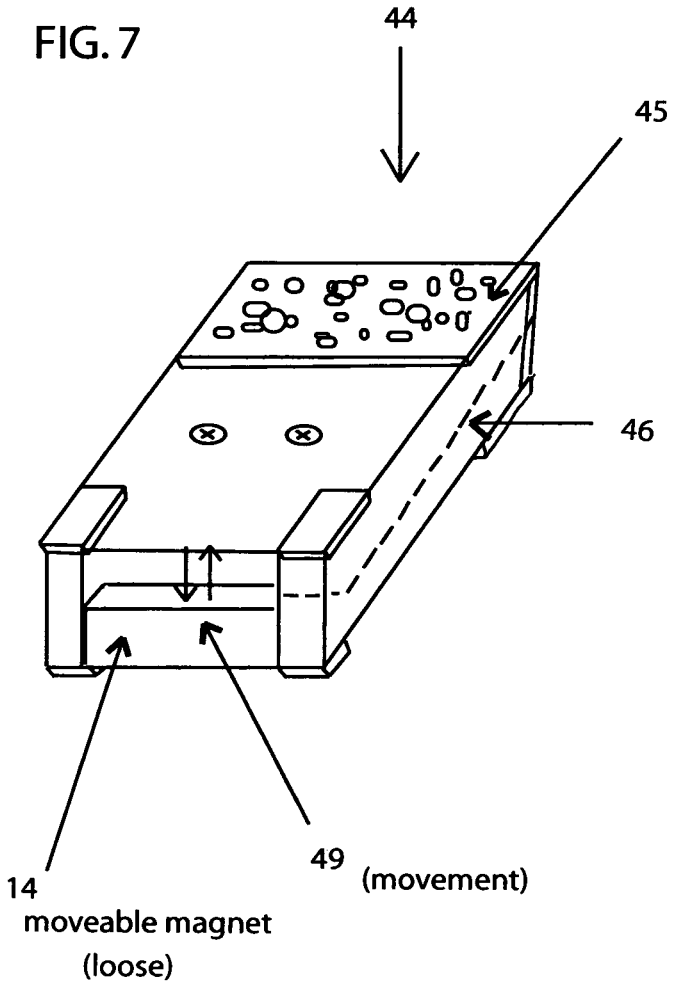
FIG. 7 is the perspective view of an alternate embodiment of the damper; showing the vertical movement of the magnet within the damper.

Referring now to FIG. 7; Still referring to the damper 10 this alternate damper 44 could have this embodiments and could take many different forms with the materials and ideas listed thus far. FIG. 7 shows a backside perspective view of a movable or floating magnet 41.

In further detail, still referring to the damper of FIG. 7; the damper 44 when flipped over, gravity will pull the magnet 41 downward 49. This damper idea 44 would not need the slot to be cut in the rigid material in order to secure to the rim of a said drum. A dampening material 45 could be permanently affixed to the rigid base 46 and turned over depending upon desired sound. The magnet 41 will make the proper connection to the metal rim of the drum similar to FIG. 6 but without the slot configuration.

In even further detail, still referring to the damper of FIG. 7; the damper 44 can move along inside of drum rim similar to damper 10, but will only work for ferrous materials. This damper 44 could be manufactured more easily and sold for the least amount.

Method of Use

Place the damper on the inside of the drum, inserting it along the rim of the said drum. When a drummer strikes the drumhead with a stick, the damper is meant to contact the drum membrane or skin directly. The damper takes the dissonant sounding resonance of the drumhead and pinpoints the unwanted frequency or unappealing "ring" of the drum. The damper has a slot that accepts the rim of the drum which is used for sliding the damper along the inside of the drum changing the sound as played until finally settling on the best tone and spot on the drum. From there, the drummer can further detail his sound with the inserts of different materials weights and textures. The weight of the damper in conjunction with the magnet's pull to the rim of the drum, keeps the said device from moving, and thus achieves the necessary adhesion without the need for clumsy attachments that may bend, break or strip, or, gooey gels that may loose stickiness by picking up lint or stain the drumhead. Also there is a specifically designed slot that will work on most of the current non ferrous or alloy rims on the market today. This is secured not by a magnet but by the precise geometry of the slot leveraging against the back of the drum rim to achieve a secure and reliable bond on every hit to the drum. To take off, it simply needs to be lifted from the back of the damper. The sliding effect works just as well with these allow rims as the ferrous rims.

Advantages

The first advantage of the damper is that it offers a range of sound modifications for a percussion instrument "quickly" and simply. Within seconds the drummer can decide the best place for the damper while hitting the drumhead with a stick in one hand and moving the magnetized damper around the perimeter with the other. The second advantage is that it is "robust" in construction and free from wearing out its parts. Made almost entirely from one piece of metal or rigid material it could last an extremely long time. The third is that the damper has a "slot" to accept non-ferrous rims and attach without clumsy screws or latches or glues or hook and loop. The fourth advantage is the damper can be taken off in the same fashion and removably adhered to the side of the metal drum for "storage". The fifth advantage is that the damper can accept "interchangeable surfaces" and materials hard or soft to more precisely tailor the specific kind of unwanted drum ring sound. The last advantage is that the "weight" of the present device adds mass to the drum itself, and once attached, turns a cheap snare drum, for instance, into a heavier more expensive and solid sounding one.

In a broad embodiment, the present device is an invention for modifying the sound made by a vibratable surface of a percussion instrument. The invention should not be limited by the above described embodiment, method, and examples, but by all embodiments and methods within the scope and spirit of the invention as claimed.

I claim:

1. A vibration damper for use with a drum instrument of the type including a membrane that is supported in a stretched state by a rigid frame and which can be selectively vibrated when the drum is played, said damper comprising:

a plate having a top surface and a bottom surface, said plate having a predetermined weight;

a damper component located between said bottom surface of said plate and said drum membrane;

so that said damper component effectively presses into vibration-dampening contact with said drum membrane by gravity influencing on said predetermined weight of said plate, there by affecting the vibration characteristics of said membrane when the drum is played, further comprising a slot located within said plate, said slot being sized and shaped to firmly fasten to a portion of said frame, hoop, or lug of said drum.

2. The damper of claim 1, wherein at least a portion of said plate is made from a ferrous material so that at least one ferrous portion can be selectively magnetically attracted to rim of drum.

3. The damper of claim 1, further comprising of a magnet so that said plate can be selectively secured to a ferrous component of said rigid frame of said drum.

4. The damper of claim 1, wherein said plate includes a first cavity which is sized and shaped to receive said first damper component.

5. The damper of claim 4, wherein said plate further includes a second cavity for receiving a second damper component.

6. The damper of claim 5, wherein said damper component is made from a first material, said damper component is made from a second material.

7. The damper of claim 1, wherein damper component is made from one of the group of leather, plastic, fabric, ferrous metal, alloy metal, paper, glass, or sand.

8. The damper of claim 1, wherein said slot is shaped similar to the shape of any engagement portion of said rigid frame, rim, or lug of said drum.

* * * * *